United States Patent [19]

Powers

[11] Patent Number: 5,004,228

[45] Date of Patent: Apr. 2, 1991

[54] LEG STRETCHING APPARATUS

[76] Inventor: Scott Powers, 5704 Euper La., Fort Smith, Ark. 72903

[21] Appl. No.: 341,432

[22] Filed: Apr. 20, 1989

[51] Int. Cl.[5] ..... A63B 21/00

[52] U.S. Cl. ..... 272/125; 272/903; 272/143

[58] Field of Search ..... 272/903, 93, 125, 126, 272/143, 96, 116, 142, 75

[56] References Cited

U.S. PATENT DOCUMENTS

| | | | |
|---|---|---|---|
| 324,498 | 8/1885 | Surbaugh | 272/126 X |
| 3,119,614 | 1/1964 | Berry | 272/125 |
| 3,369,809 | 2/1968 | Morrill, Jr. | 272/125 |
| 3,843,119 | 10/1974 | Davis | 272/125 X |
| 3,925,901 | 12/1975 | McCormick | 272/903 X |
| 4,177,542 | 12/1979 | Denney | 272/143 X |
| 4,588,186 | 5/1986 | Calabrese | 272/126 |
| 4,819,936 | 4/1989 | Muller | 272/903 X |

*Primary Examiner*—Richard J. Apley
*Assistant Examiner*—D. F. Crosby
*Attorney, Agent, or Firm*—Head & Johnson

[57] ABSTRACT

A leg stretching apparatus comprises two handgrip placement straps which are connected to a foot support member. Handgrips are threaded onto the handgrip placement strap which are held in place by adjustable clips. The adjustable clips allow the handgrips to be adjusted to proper length. In operation, an individual sits on the floor in a "pike" position, grasping the handgrips in stages to stretch the legs and lower back.

5 Claims, 2 Drawing Sheets

LEG STRETCHING APPARATUS

BACKGROUND—FIELD OF INVENTION

The present invention relates generally to exercise equipment and relates specifically to a stretching apparatus.

BACKGROUND—DESCRIPTION OF PRIOR ART

Fitness enthusiasts, runners, gymnasts, athletes, and low back pain sufferers are encouraged to stretch to increase flexibility and reduce injuries. The hamstring muscles and muscles in the lower back area are especially important to keep flexible because these muscle groups tend to tighten as we get older and can cause lower back pain and other injuries.

One of the most common ways to stretch these muscle groups is by sitting on the floor, with legs straight in front, reaching toward the toes, in a "pike" position This manuever is difficult and uncomfortable for most people. The ideal stretch requires stretching slow and gradual, holding each stretch for 10–30 seconds. This allows muscle fibers to stretch to their maximum, avoiding injury. Many people overstretch the muscles by bouncing, this can cause tears in the muscle fibers and ligaments, causing very painful injuries. It has been documented in exercise physiology that "static" stretching (slow, gradual, in stages) is much more effective than "ballistic" (bouncing) stretching.

In the past, various types of leg stretching apparatus have been used. However, many apply to marshal arts training and ballet in which flexibility is enhanced by stretching in the "split" position, which primarily stretches the inner thigh muscles.

U.S. Pat. No. 4,277,062 to Mark Lawrence discloses a leg stretching apparatus utilizing a cable-pulley system in which the legs are stretched into a "split" position, stretching the inner thigh muscles.

U.S. Pat. No. 4,456,247 to Ted Ehrenfried relates to an apparatus that utilizes a hand cranking device that also stretches the legs into a "split" position.

While both of these devices are good for marshal arts training or ballet, the present invention is practical for any age group whether athletic or non-athletic Another method for stretching is the "towel" stretch. The towel is wrapped around the feet and the operator grasps the ends of the towel to stretch similar to the present invention. However, there are several disadvantages: there are no handgrips to hold, it is harder to stretch in even stages, and there are no means to measure the improvement in flexibility.

OBJECTS AND ADVANTAGES

Therefore, in view of the above and other disadvantages of prior art leg stretching apparatuses, it is an object of the present invention to provide a leg stretching apparatus that enables the individual to stretch the hamstring and lower back muscles in a safe, slow and comfortable manner.

It is a further object of the present invention to provide a method to measure improvement in flexibility visibly by providing individual handgrips.

It is a further object of the present invention to provide the user a means to stretch in several stages which is the most efficient and safe way to stretch.

It is further an object of the present invention to provide an apparatus to stretch the upper body (arms and shoulders).

Additionally, it is an object of the present invention to provide a practical, small, and inexpensive device which is easily transportable, but very effective in increasing flexibility of the hamstring and lower back muscles.

BRIEF DESCRIPTION OF THE DRAWINGS

Other objects and advantages may be seen from the following description when viewed in conjunction with the accompanying drawings wherein.

DETAILED DESCRIPTION OF PREFERRED EMBODIMENTS

Figure 1:
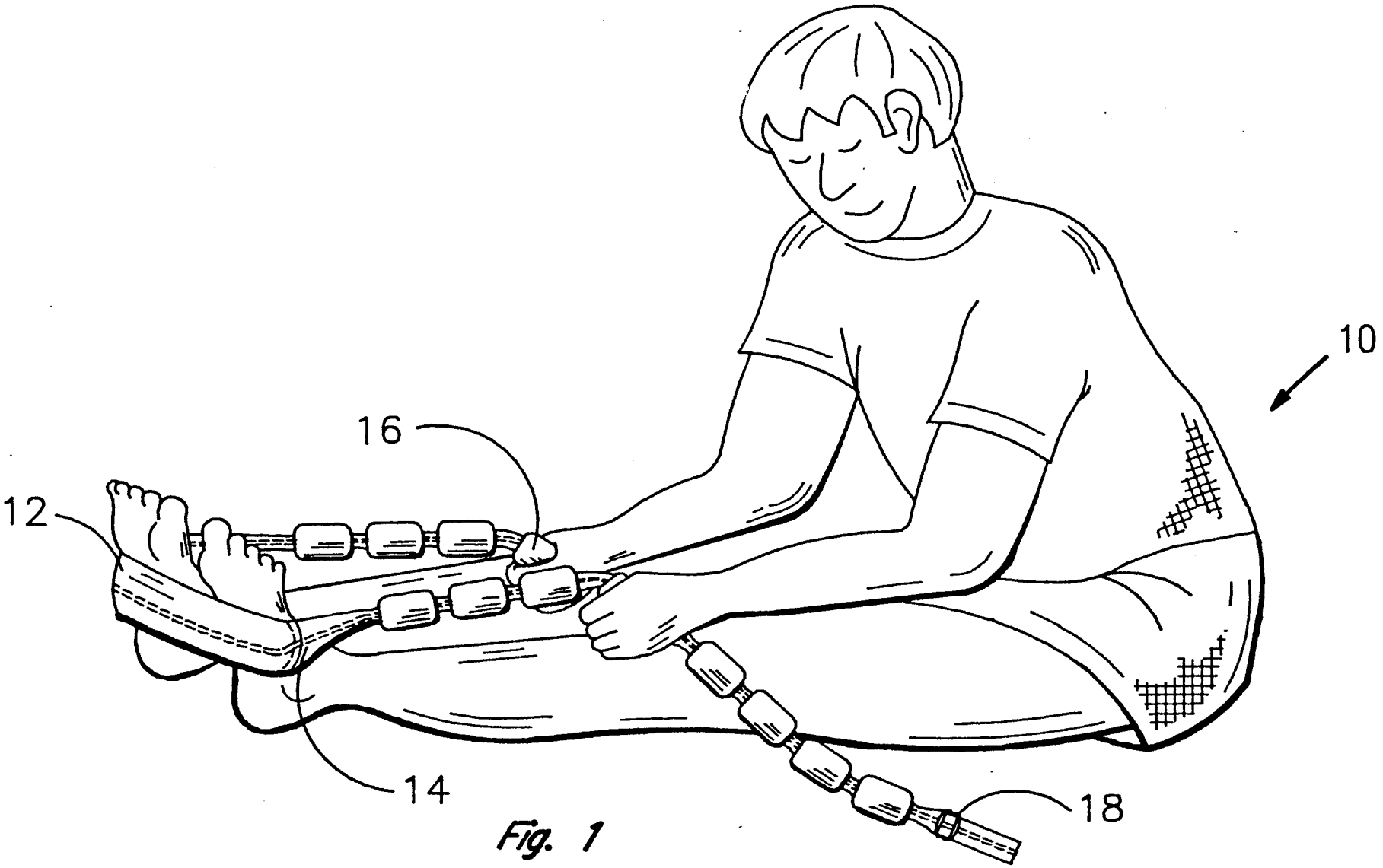
FIG. 1 is a perspective view of an individual using the leg stretching apparatus.

Referring now more particularly to the drawings, wherein like numerals represent like elements throughout several views. FIG. 1 generally shows the operator position and use of the leg stretching apparatus. The operator 10 is seated on the floor. The feet are placed in the foot supporting means 12, which is connected to the handgrip placement strap 14, in which the operator grasps the handgrips 16, which are held in place by an adjustable clip 18, as will be seen more clearly in later figures.

Figure 2:
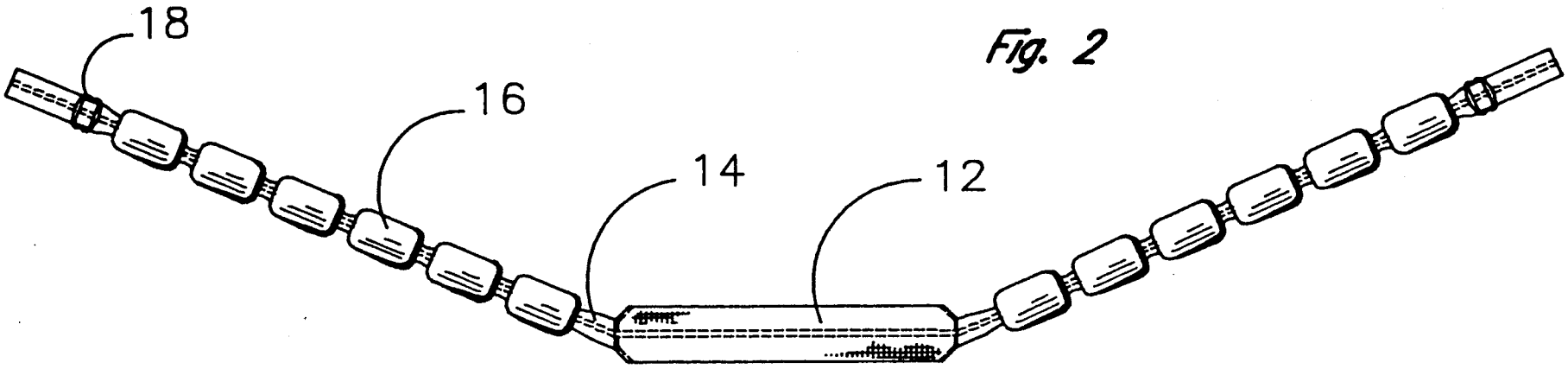
FIG. 2 is a front view, in a horizontal plan, of the present invention.
Figure 3:
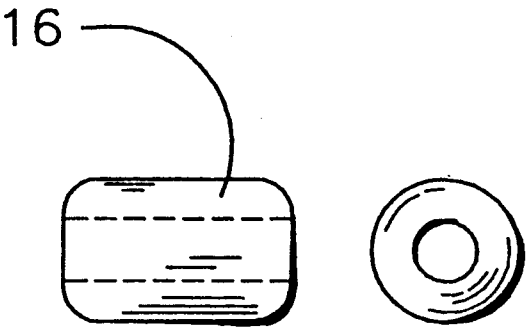
FIG. 3 is an enlarged side view of an individual handgrip.

Referring now to FIG. 2 of the drawings, the foot supporting means 12, and the handgrip placement strap 14, are comprised of a preferred embodiment, in this instance, nylon webbing. The handgrips 16, are comprised of a preferred embodiment, in this instance, wood, and are threaded onto the handgrip placement strap 14, through holes drilled in the center. The handgrips 16 are held in place by an adjustable clip 18, which is comprised of a preferred embodiment, in this instance, metal. FIG. 3 shows the shape of the handgrips 16 which are contoured on each end to facilitate ease of gripping.

Depending on the ultimate user of such a device, many different materials could be used for the foot supporting means, and handgrip placement strap. Such materials would be constructed from wood, plastics, or metal materials. Additionally, the adjustable clip could be constructed of many materials such as plastic, metal or wood. It is also clear that the geometry of the foot supporting means, handgrip placement strap, handgrips, and adjustable clip could be changed substantially without departing from the spirit of the present invention. Additionally, the method for securing the handgrip placement strap to the handgrips could be changed depending on how much travel would be desired for a given displacement of the handgrips.

I claim:

1. A leg stretching apparatus to allow a user to stretch hamstring and lower back muscles, which apparatus comprises: a foot support strap having two ends; a pair of handgrip placement straps, one of said handgrip placement straps extending from each said end of said foot support strap, and each handgrip placement strap terminating in an adjustable clip means; a plurality of handgrips, each handgrip having a hole therethrough to slidably receive one of said handgrip placement straps, whereby said handgrips are retained on said handgrip placement straps by said clip means and adjustment of said clip means will determine the position of said handgrips along each said handgrip placement strap.

2. A leg stretching apparatus as set forth in claim 1 wherein said foot support strap and said handgrip placement straps are flexible yet non-elastic.

3. A leg stretching apparatus as set forth in claim 1 wherein each said handgrip has an exterior shape to fit within the palm of said user's hand.

4. A leg stretching apparatus as set forth in claim 3 wherein each said handgrip has an exterior shape in the form of a bead.

5. A leg stretching apparatus as set forth in claim 3 wherein said handgrips may be sequentially held in said user's hands.

* * * * *